US008469090B2

(12) United States Patent
Rossi et al.

(10) Patent No.: US 8,469,090 B2
(45) Date of Patent: Jun. 25, 2013

(54) METHOD FOR MONITORING HYDROCARBON PRODUCTION

(75) Inventors: Marcus Rossi, Bahia (BR); Jean-Claude Vernus, Rio de Janeiro-RJ (BR); Abul K. M. Jamaluddin, Kuala Lumpur (MY)

(73) Assignee: Schlumberger Technology Corporation, Sugar Land, TX (US)

( * ) Notice: Subject to any disclaimer, the term of this patent is extended or adjusted under 35 U.S.C. 154(b) by 513 days.

(21) Appl. No.: 12/628,639

(22) Filed: Dec. 1, 2009

(65) Prior Publication Data

US 2011/0127032 A1 Jun. 2, 2011

(51) Int. Cl.
*E21B 49/08* (2006.01)
*E21B 47/00* (2012.01)

(52) U.S. Cl.
USPC ..... 166/250.01; 166/336; 166/344; 166/264; 702/12

(58) Field of Classification Search
USPC ..... 166/250.01, 336, 344, 351, 352, 166/367–369, 264, 66; 73/152.02; 702/6, 702/11–13; 703/10
See application file for complete search history.

(56) References Cited

U.S. PATENT DOCUMENTS 4,969,130 A * 11/1990 Wason et al. ..... 367/73
5,335,730 A * 8/1994 Cotham, III ..... 166/374
5,680,899 A * 10/1997 Waid et al. ..... 166/250.01
5,975,204 A * 11/1999 Tubel et al. ..... 166/250.15
6,192,980 B1 * 2/2001 Tubel et al. ..... 166/65.1
6,266,619 B1 * 7/2001 Thomas et al. ..... 702/13
6,356,844 B2 * 3/2002 Thomas et al. ..... 702/12
6,618,677 B1 * 9/2003 Brown ..... 702/13
6,644,848 B1 * 11/2003 Clayton et al. ..... 374/7
6,871,118 B2 * 3/2005 Henriot et al. ..... 700/266
6,980,940 B1 * 12/2005 Gurpinar et al. ..... 703/10
7,266,456 B2 * 9/2007 De Guzman et al. ..... 702/13
7,478,024 B2 * 1/2009 Gurpinar et al. ..... 703/10
7,512,543 B2 * 3/2009 Raghuraman et al. ..... 705/7.28
7,530,398 B2 * 5/2009 Balkanyi et al. ..... 166/344

(Continued)

FOREIGN PATENT DOCUMENTS

WO 01/29370 4/2001

OTHER PUBLICATIONS

A. Gudimetla, et al, "Gulf of Mexico Field of the Future: Subsea Flow Assurance," OTC 18388, 2006.

(Continued)

*Primary Examiner* — Matthew Buck
(74) *Attorney, Agent, or Firm* — Matthias Abrell

(57) ABSTRACT

A method is described for monitoring a fluid flow in a flow line from a location in a subterranean reservoir to a surface storage or production facility using the steps of employing sensors located in the wellbore, along the flow line and surface systems for monitoring flow conditions, establishing parameters which determine the hydrocarbon phases like liquids and gases, precipitation of solid components from the fluid flow as a result of changes in temperature, pressure and compositions, setting alert parameters relating to the precipitation parameters, and determining an operating profile representative of present conditions along the flow line, wherein the precipitation parameters, the alert parameters and the operating profile and extrapolation of the operating profile are represented in a single parameter space.

14 Claims, 7 Drawing Sheets

U.S. PATENT DOCUMENTS

| | | | | |
|---|---|---|---|---|
| RE41,999 | E * | 12/2010 | Thomas et al. | 702/13 |
| RE42,245 | E * | 3/2011 | Thomas et al. | 702/13 |
| 7,918,283 | B2 * | 4/2011 | Balkanyi et al. | 166/344 |
| 7,921,916 | B2 * | 4/2011 | Lovell et al. | 166/336 |
| 7,967,066 | B2 * | 6/2011 | McStay et al. | 166/250.01 |
| 8,121,790 | B2 * | 2/2012 | Kimminau et al. | 702/11 |
| 8,122,965 | B2 * | 2/2012 | Horton et al. | 166/366 |
| 8,131,470 | B2 * | 3/2012 | Yusti et al. | 702/12 |
| 2004/0059505 | A1 | 3/2004 | Gallagher | |
| 2005/0283276 | A1 | 12/2005 | Prescott et al. | |
| 2008/0065362 | A1 * | 3/2008 | Lee et al. | 703/10 |
| 2008/0234939 | A1 * | 9/2008 | Foot et al. | 702/12 |
| 2010/0274491 | A1 * | 10/2010 | Andersen et al. | 702/13 |

OTHER PUBLICATIONS

G.G. Lunde, et al, "Advanced Flow Assurance System for the Ormen Lange Subsea Gas Development, "OTC 20084, 2009.

J. Ratulowski, et al., "Flow Assurance and Subsea Productivity: Closing the Loop with Connectivity and Measurements," SPE 90244-MS, 2004.

A. Amin, et al, "Role of Surveillance in Improving subsea Productivity," SPE 90209-MS, 2004.

A.K.M Jamaluddin, et al, "A Systematic Approach in Deepwater Flow Assurance Fluid Characterization," SPE 71546-MS.

* cited by examiner

METHOD FOR MONITORING HYDROCARBON PRODUCTION

FIELD OF THE INVENTION

The invention relates to an alert system and related methods to monitor hydrocarbon production facilities including downhole installations, wellhead, long tie-backs between oil-wells and storage tanks or processing plants.

BACKGROUND

During the production of hydrocarbons, the hydrocarbons and other by-products flow from the wells drilled into the reservoir to storage facilities or a processing plant. The pipelines and other installations required for this transport are usually referred to as tieback. The flow of hydrocarbon is subject to changing environmental conditions such as changing temperature, pressure, and composition. The changing conditions often cause the precipitation of components out of the main flow.

In this context, management of changing phases like liquids, gases and solids precipitation can be regarded as being fundamental for the assurance of fluid flow along the production systems. Organic (hydrates, waxes, Asphaltenes, naphthanates) or inorganic solids ($BaSO_4$, $CaCO_3$, $SrCO_3$) may obstruct the formation pores and deposit on the wellbore or pipeline walls blocking the fluid production.

In the oil and gas industry, studies are developed to analyze the flow conditions and operations procedures throughout the life of the field. The objective of those studies is to understand the environment, boundary conditions and property changes along the fluid journey from the pore volume of the reservoir to process facilities and point of sales.

To characterize the production, the oil and gas industry is recently focusing, particularly for large subsea developments, on intelligent field solutions and new systems for production control and monitoring as for example presented in: Gudimetla, A. Carroll, K. Havre, C. Christiansen, and J. Canon, "Gulf of Mexico Field of the Future: Subsea Flow Assurance", OTC 18388, 2006 and G. G. Lunde, K. Vannes, O. T. McClimans, C. Burns, and K. Wittmeyer, "Advanced Flow Assurance System for the Ormen Lange Subsea Gas Development", OTC 20084, 2009. These recent systems for production management are designed to assist decision making and to provide guidance for the daily operations and future investments. They can perform model-based simulations to represent the production conditions and address potential issues. Generally these systems attempt to address flow assurance problems.

The model-based simulations represent reservoirs, wells, pipelines, production networks and facilities. Those models range from "black oil" to compositional and from steady state to transient. When calibrated with available measurement data as proposed for example in J. Ratulowski, A. Amin, A. Hammami, M. Muhammad, M. Riding, "Flow Assurance and Subsea Productivity Closing the Loop with Connectivity and Measurements", SPE 90244-MS, 2004 or by A. Amin, E. Smedstad, M. Riding, "Role of Surveillance in Improving Subsea Productivity", SPE 90209-MS, 2004 and laboratory fluid characterization data such as illustrated in: A. K. M. Jamaluddin, J. Nighswander, N. Joshi, "A Systematic Approach in Deepwater Flow Assurance Fluid Characterization", SPE 71546-MS, 2001, such models can be used to estimate fluid properties throughout the system.

Software tools to assist the assessment of potential flow assurance problems are commercially available by many vendors and include for example steady-state fluid flow simulators such as PIPESIM™, transient fluid flow simulators such as OLGA™, fluid analysis software designed to predict the thermodynamic precipitation point of waxes and asphaltenes such as dbrSOLIDS™, and integrated asset modeler simulators such as Avocet™ IAM capable of modeling the fluid flow from the reservoir through to refining stages. Those tools allow production engineers to understand potential system problems, such as flow restrictions due to solids precipitation and deposition.

The use of the model-based simulation to create operation profiles is well known in the industry, these profiles are used to evaluate the risk of solids precipitation and deposition along the flow path. However in the light of the known methods it is seen as an object of the present invention to provide a method of monitoring different types of possible solids from each fluid footprint, and at different timeframes.

SUMMARY OF INVENTION

The present invention provides a method for monitoring a fluid flow in a flow line from a location in a subterranean reservoir to a surface storage or production facility using the steps of employing sensors located in the wellbore and along the flow line for monitoring flow conditions, establishing parameters which determine the precipitation of solid components from the fluid flow, setting alert parameters relating to the precipitation parameters, and determining an operating profile representative of present conditions along the flow line, wherein the precipitation parameters, the alert parameters and the operating profile and extrapolation of the operating profile are represented in a single parameter space.

The invention provides in a preferred embodiment a method of representing important flow assurance parameter as linked to the precipitation of organic and/or inorganic flow components in a compact representation. This representation facilitates the setting, the monitoring and the display of alarm thresholds.

In another preferred embodiment, the invention includes the use of subterranean sensors to update flow models of the reservoir so as to provide a long-term projection or extrapolation of the operating profile. In turn, this extrapolation in combination with the other features of the present invention can be used to define operating guidelines which reduce or avoid precipitation.

These and other aspects of the invention are described in greater detail below making reference to the following drawings.

DETAILED DESCRIPTION

Figure 1:
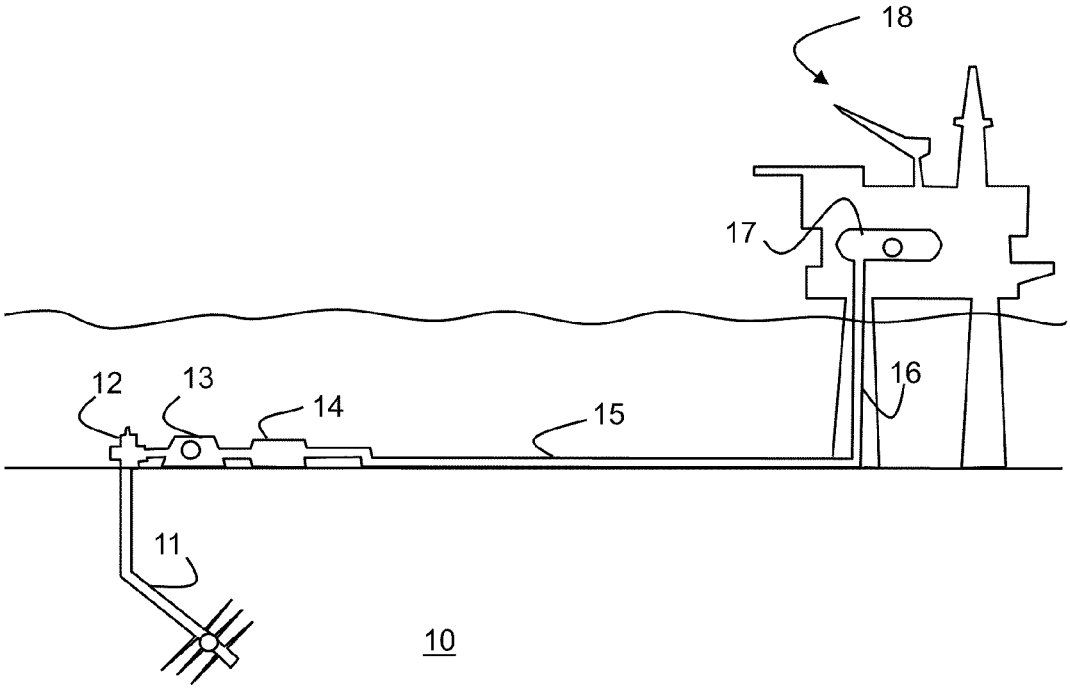
FIG. 1 illustrates an schematic example of a production system.

In the following example FIG. 1 shows a schematic example of an off-shore subsea production system, which represents the fluid journey from the pore volume of the reservoir 10 to an initial processing facility 17 on an offshore platform 18. The fluid path includes a subterranean completion 11, a well head 12 located at the seabed, a subsea manifold 13, pumping devices 14 and a subsea pipeline or tie-back 15 through a marine riser 16 to the platform 18. The fluid path is regularly monitored due its changing conditions relating to pressure, temperature and flow rates. Key points of this monitoring system along the production system include the reservoir, the manifold and the production platform are highlighted with circles and referred to in the following figures and plots.

The system can be implemented using known subsea and surface devices as described in the above cited documents and particularly in G. Deans, R. MacKenzie, "Enabling Subsea Surveillance: Embracing "True Production Control" With An Open Architecture Subsea Monitoring And Control System", Conference Subsea Controls and Data Acquisition 2006: Controlling the Future Subsea, Jun. 7-8, 2006, Neptune, France SCADA-06-074.

Figure 2:
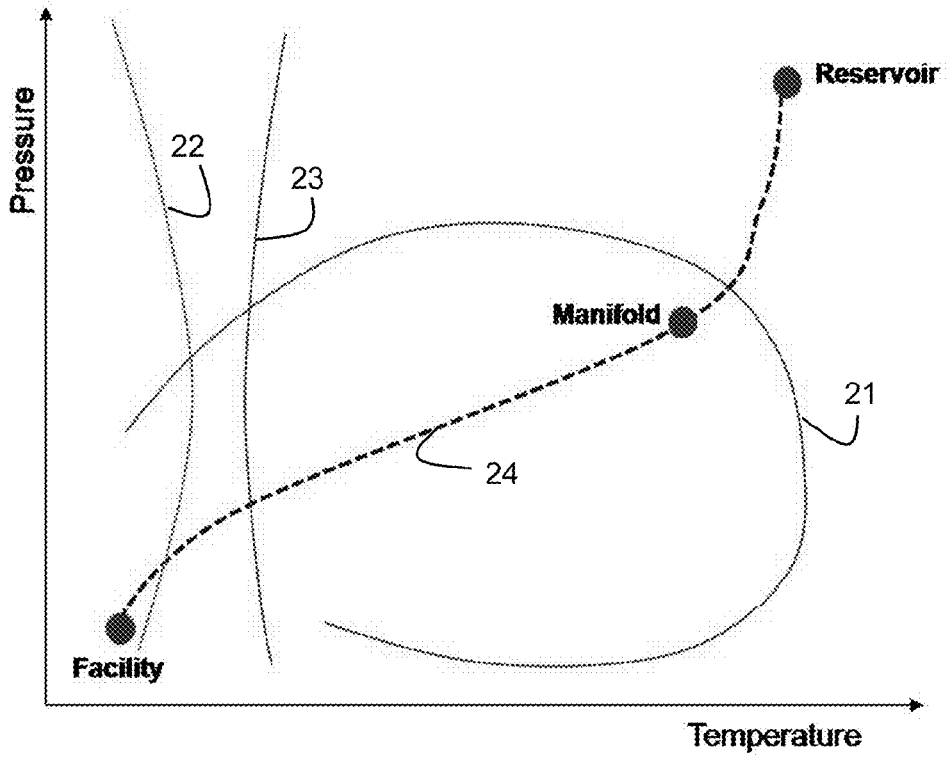
FIG. 2 is a reduced version of a diagram combining precipitation curves and operating profile.

Using such an infrastructure of sensors and other monitoring devices, different commercial software packages as referred to above can be used to calculate the fluid multiphase envelope and operating profiles. A schematic example of phase envelopes combined with an operating profile in a P-T or thermo-hydraulic plot is shown in FIG. 2. This plot demonstrates how the flow assurance surveillance and alarm system as proposed by the present invention enables a definition, monitoring and display of alert threshold for solid precipitation. The figure shows the fluid phase envelope 21, a hydrate precipitation curve 22, a wax precipitation curve 23 and an operating profile 24. The circles on the dashed line 24 of the operating profile indicate critical path points (reservoir, manifold, facility) as identified in FIG. 1 above.

Figure 3A:
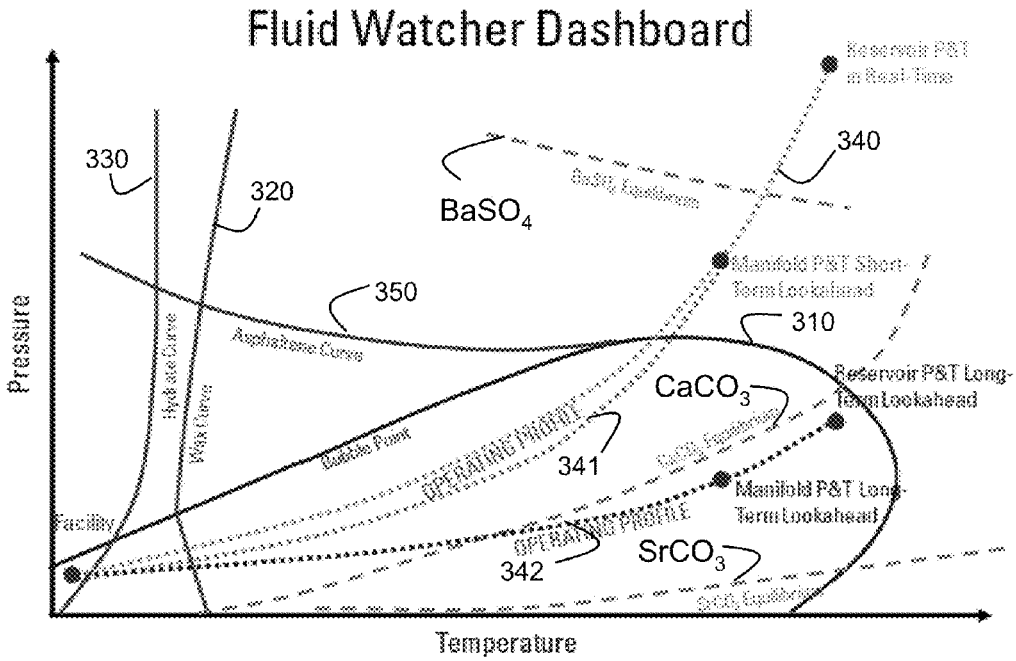
FIGS. 3A-D illustrate a more detailed version of a diagram combining precipitation curves, alert curves and real-time and extrapolated operating profiles.

A more complex example is shown in FIG. 3A. This figure include not only the phase envelope or bubble point curve 310, the wax curve 320 and the hydrate curve 330 as in FIG. 2, it also includes an asphaltene precipitation curve 350 and further inorganic solids equilibrium curves such as barium sulfate ($BaSO_4$), calcium carbonate ($CaCO_3$) and strontium carbonate ($SrCO_3$). In the example, real-time data acquisition from field instrumentation is combined with laboratory fluid characterization data to run simulation models for monitoring the production system via the operating profiles 340 and their extrapolations 341, 342 in time. Details of this complex diagram are shown in isolation in the following two figures.

Figure 3B:
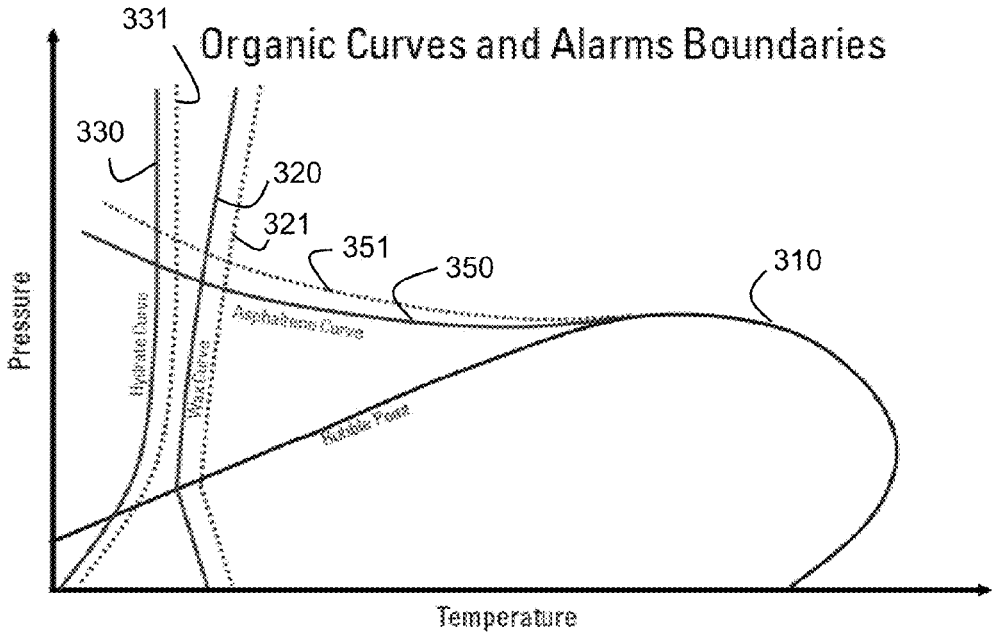

In FIG. 3B, the precipitation curves of the organic flow hindrance components of FIG. 3A are shown in isolation, i.e., the phase envelope or bubble point curve 310, the wax curve 320, the hydrate curve 330 and the asphaltene precipitation curve 350. Each of the wax curve 320, the hydrate curve 330 and the asphaltene precipitation curve 350 are shown shadowed by respective alarms boundaries 321, 331, 351 shown as dotted lines. The alarm boundaries are set by the operator for example in accordance with the operator's risk management strategy. Taking wax as an example and assuming the produced fluid has a WAT (Wax Appearance Temperature) of 30° C. and the operator consider that 10% above this temperature should be an alert zone, an offset alarm curve 321 as shown is defined. An alarm is triggered if the operating profile reaches the alert curve. Similar procedures can be applied to define the alarm curves 331, 351 for the other organic solids.

Figure 3C:
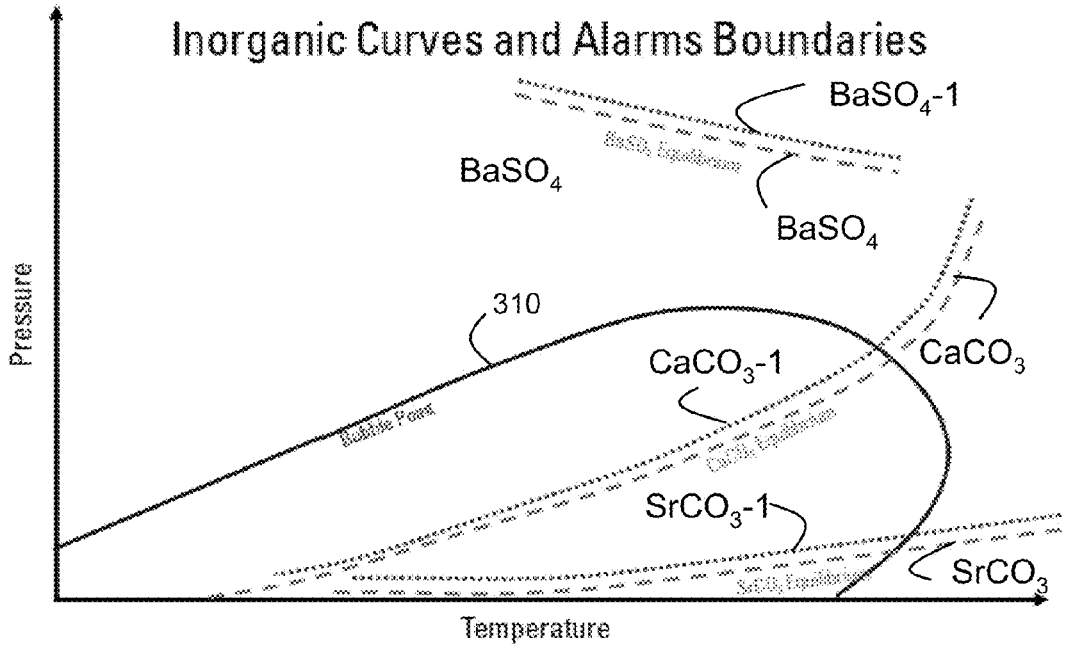

In FIG. 3C, it is the precipitation curves of the inorganic flow components of FIG. 3A, which are shown in isolation with the bubble point curve 310, i.e., the barium sulfate ($BaSO_4$), the calcium carbonate ($CaCO_3$) and strontium carbonate ($SrCO_3$) curves. Each of the curves are shown shadowed by respective alarms boundaries $BaSO_4$-1, $CaCO_3$-1, and $SrCO_3$-1 represented by dotted lines. The alarm boundaries can be set by the operator in accordance with a risk management strategy.

Figure 3D:
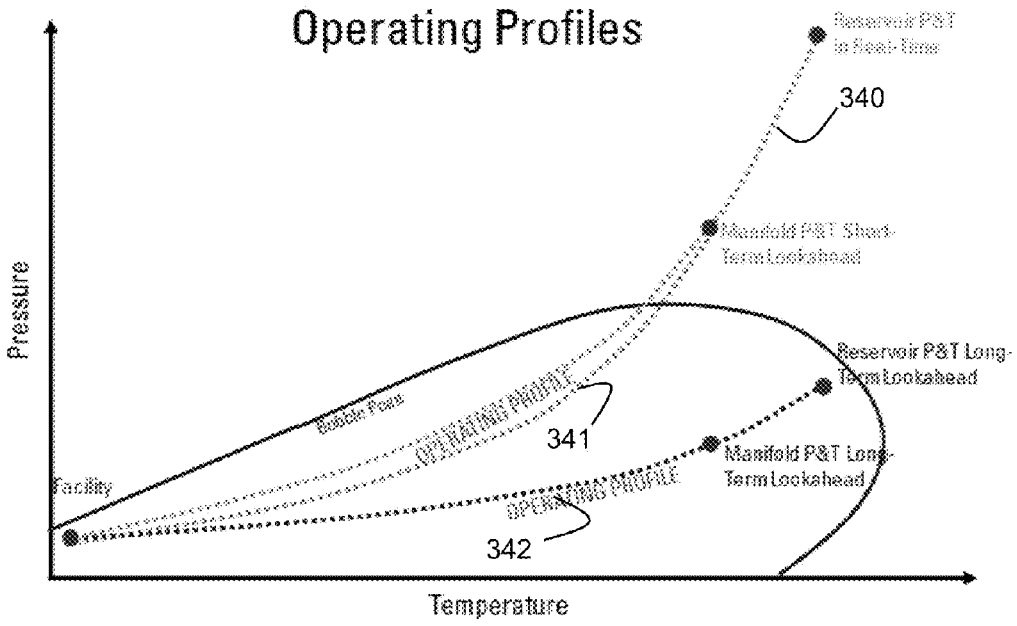

The operating profiles 340 and their extrapolations 341, 342 in time of FIG. 3A are shown in isolation in FIG. 3D. In the example, the first operating profile 340 is a real-time representation of the operating conditions in the P-T plot. The production system model and fluid modeling combined with the real-time data available from instrumentation for validation are used to generate this real-time model-based simulation curve for the purpose of real-time monitoring.

The first extrapolated curve 341 can be referred to as a daily production look-ahead operating profile. This profile is taken as an example of a short-term look-ahead scenario for production operations surveillance as generated best by a transient simulation model such as OLGA. It provides an overview of the possible event on the near future. On this profile the look-ahead or extrapolation time step should be relatively short ranging for example from minutes to days. For this short period the conditions on the reservoir pressure and temperature should not change significantly. Hence the model can be limited to the extrapolation of the operating conditions from the wellhead and beyond.

In case the short-term look-ahead scenario touches the alarm boundaries, the system is capable of indicating the need for remedial action. The alert enables an operator to schedule remedial action ahead of time, hence avoiding or reducing potential bottlenecks or loss of production.

The second extrapolated curve 342 can be referred as reservoir management look-ahead operating profile. This profile is taken as an example of a long-term look-ahead scenario and is generated from an integrated simulator by coupling a reservoir model with the production system model. The reservoir model is a geological model of the subsurface reservoir 10 and can be built by combining available seismic, logging and other geophysical data using standard software tools such as Petrel™. To model the fluid flow in the reservoir it may be necessary to combine the reservoir model with a flow modeling software such as Eclipse™. The long-term look-ahead scenario seeks to encompass changes in the reservoir and hence its time steps are measured typically in weeks or months or even years. It can be scheduled in line with full field reviews or assessments, which require an extended forecast of the field operations based on the future conditions. A benefit of long-term look-ahead scenario is expected to be the capability of changing production conditions such that precipitation is reduced or avoided without having to resort to remedial actions, hence enabling preventive actions.

All the data acquired from field instrumentation and sensors and generated by the simulators as described above are fed into a data hub that assures the correct data flow between the software packages to monitor the selected parameters and regulate the surveillance alarms. A flow chart listing components and steps of the above example of the invention is illustrated in FIG. 4.

Figure 4:
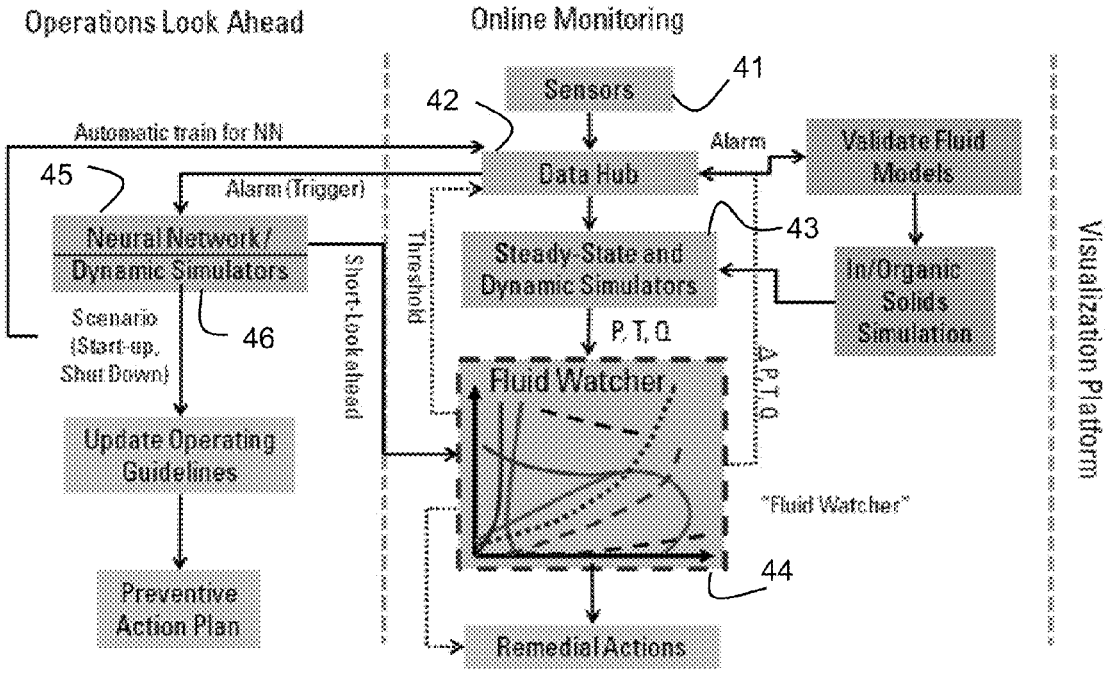
FIG. 4 is a block diagram showing elements and steps of an example of the present invention.

The system as described by FIG. 4 includes interfaces to real-time and other sensors 41 detecting and monitoring changes of external parameters along the path of the fluid from the well to the processing facility. The interfaces link the field sensor output to a data hub 42, which acts as a data formatting and storage center providing in turn a data flow to the simulation 43 and graphic display unit 44.

The simulators 43 used for this example are combining steady-state simulator and transient state simulator.

The system has three main operating modes. The first monitors the operating profile in real-time to generate alerts, if the real-time operating profiles crosses a precipitation curve. The second mode monitors the crossing of the real-time operating profile with any of the alerts curves or thresholds defined above. In this mode, alarms can be raised by the system and a short-term look-ahead simulation can be initiated.

Further components include data-driven models such as neural networks 45 to adjust the system based on past conditions and a reservoir simulator 46 to provide a long-term look-ahead simulation of the operating profile. The long-term look-ahead simulation can be part of the decision making process to change well and production parameters such that the operating profile remains within the desired limits as defined by solid precipitation.

The above system includes a static configuration part which defines an operational space the boundaries of which are at least partly defined by the solid precipitation curves. It defines the parameter space in which the operating profile can change without triggering remedial action. In another variant, the static part can be at least partially replaced by a constant update as provided by sensors performing a real-time compositional flow analysis.

The system also has a second dynamic component, the monitoring part, which receives field data and updates simulation results to determine real-time and extrapolated operating profiles and display these profiles with the operational space as defined by the configuration part. A third component, the diagnostic part, is initiated or triggered boundary condition violation leading to decisions on short-, medium- or long term remedial action and, if required, to a model re-calibration. By its nature this latter part is invoked sporadically as alert thresholds or precipitation boundaries are approached or crossed by the operating profile.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative processes, one skilled in the art will recognize that the system may be embodied using a variety of specific procedures and equipment and could be performed to evaluate widely different types of applications. Accordingly, the invention should not be viewed as limited except by the scope of the appended claims.

What is claimed is:

1. A method of monitoring a fluid flow in a flow line from a location in a subterranean reservoir to a surface storage or production facility, said method including the steps of using sensors located along said flow line for monitoring flow conditions;

establishing parameters which determine precipitation of solid components from said fluid flow;

setting alert parameters relating to said precipitation parameters; and determining an operating profile representative of present conditions along said flow line, wherein said precipitation parameters, said alert parameters and said operating profile are represented in a single parameter space;

wherein establishing parameters which determine precipitation of solid components comprises calculating at least one of a fluid multi-phase envelope or a fluid multi-phase operating profile.

2. A method in accordance with claim 1, wherein the parameter space is the pressure-temperature space.

3. A method in accordance with claim 1, further comprising the step of extrapolating the operating profile in time.

4. A method in accordance with claim 3, wherein the extrapolation is performed using transient-state and/or steady-state simulation.

5. A method in accordance with claim 3, wherein the extrapolation is performed for short and/or long periods of time.

6. A method in accordance with claim 4, wherein the simulation includes a reservoir simulation.

7. A method in accordance with claim 1, wherein the solids include organic and inorganic solids.

8. A method in accordance with claim 1, wherein the sensors are located in the subterranean environment, in the wellhead, along said flow line.

9. A method in accordance with claim 8, having sensors are located in a marine riser section of flow line.

10. A method in accordance with claim 1, wherein the precipitation parameters, the alert parameters and the operating profile are graphically displayed on a single graphical display screen.

11. A method of monitoring a fluid flow in a flow line from a location in a subterranean reservoir to a surface storage or production facility, said method including the steps of:

monitoring fluid flow conditions along the flow line;

establishing parameters which determine precipitation of solid components from said fluid flow;

setting alert parameters relating to said precipitation parameters; and generate an alert when fluid flow conditions cross an alert parameter;

wherein establishing parameters which determine precipitation of solid components comprises calculating at least one of a fluid multi-phase envelope or a fluid multi-phase operating profile.

12. The method of claim 11, further comprising determining a corrective action based on the alert.

13. The method of claim 11, further comprising taking a corrective action based on the alert.

14. The method of claim 11, further comprising:

determining an extrapolated operating profile; and generating an alert if the extrapolated operating profile crosses an alert parameter.

* * * * *